United States Patent [19]

Luebkeman

[11] 3,945,638

[45] Mar. 23, 1976

[54] BASKETBALL PRACTICE NET

[76] Inventor: Hart H. Luebkeman, c/o Trius Products Inc., Howell & Porter Sts., Cleves, Ohio 45002

[22] Filed: Feb. 14, 1975

[21] Appl. No.: 549,970

[52] U.S. Cl. ..... 273/1.5 A
[51] Int. Cl.[2] ..... A63B 63/02
[58] Field of Search ..... 273/1.5 R, 1.5 A, 103, 273/105 R, 105 A, 95 R

[56] References Cited

UNITED STATES PATENTS

| | | | |
|---|---|---|---|
| 1,765,269 | 6/1930 | Hatley | 273/1.5 A |
| 2,838,308 | 6/1958 | Polite | 273/103 |
| 2,889,149 | 6/1959 | Williams | 273/103 |
| 3,799,543 | 3/1974 | Steele | 273/1.5 A |
| 3,814,421 | 6/1974 | Spier | 273/1.5 A |

*Primary Examiner*—Richard C. Pinkham
*Assistant Examiner*—Marvin Siskind
*Attorney, Agent, or Firm*—Walter S. Murray

[57] ABSTRACT

An improved basketball practice device to be attached to and beneath the hoops of existing basketball goals and adapted to direct basketballs passed through said hoops to a play area in front of said goals to improve the shooting ability of youths.

1 Claim, 3 Drawing Figures

BASKETBALL PRACTICE NET

This invention relates to improvements in basketball return devices to be attached to the hoops of basketball goals and is particularly directed to a ball return device adapted for use with basketball goals in playgrounds and the backyards of private houses, or the like, for practicing and improving the shooting ability of youths.

It is an object of this invention to provide a basketball return device that is rugged yet simply constructed and which may be contracted into a relatively small package for retail trade outlets.

Another object of the invention is to provide a basketball return device susceptible of ready attachment to standard outdoor type basketball hoops and which will withstand all weather conditions and provide maximum ball return functions for the practice of all kinds of basketball shots.

Other objects and features of the invention will be apparent from the following description and illustrated in the accompanying drawings wherein.

Figure 1:
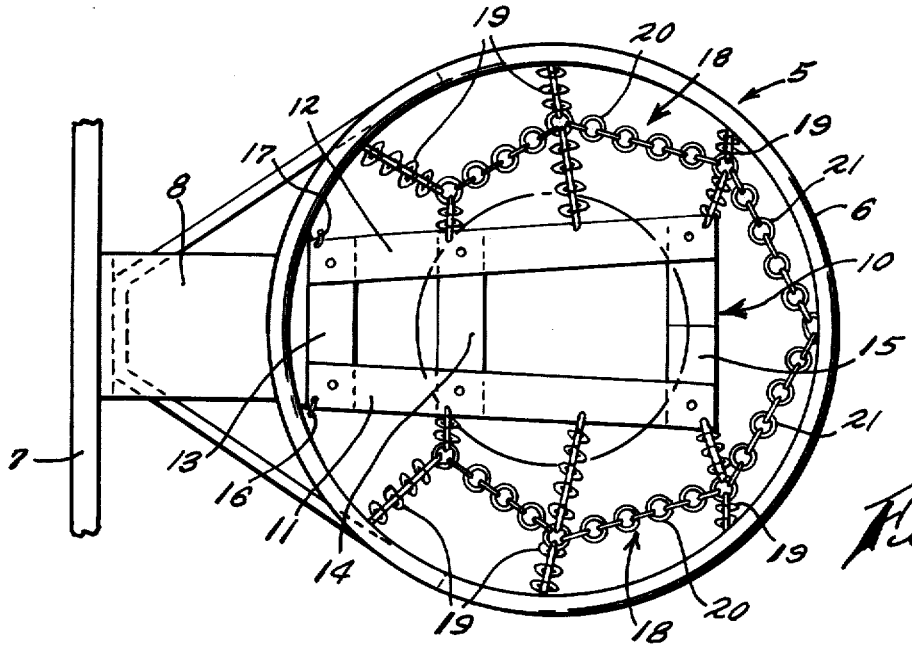
FIG. 1 is a top plan view of my basketball practice device mounted in operative position on the hoop of a standard goal.
Figure 2:
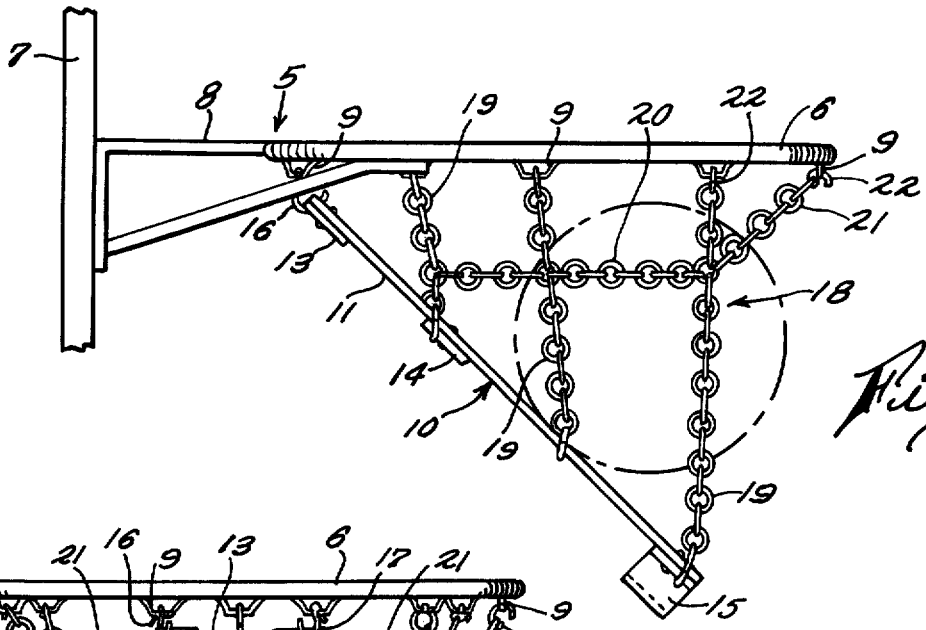
FIG. 2 is a side elevational view of the practice device shown in FIG. 1.

With reference to the drawings the numeral 5 generally indicates a standard basketball goal having a hoop 6 mounted upon a backboard 7 by means of a bracket 8. The backboard is usually supported upon a standard (not shown) and a series of angularly spaced apart eyes 9 are fixed to and depending from the hoop and are commonly used to attach a net to the hoop.

The basketball practice device of this invention includes a downwardly extending, forwardly inclined ball deflector member 10 hung subjacent the hoop 6 and having its body located wholly within the vertical extension lines of said hoop. The member 10 comprises a pair of plates 11 and 12 which diverge forwardly (FIGS. 1 and 3) and are connected together by cross plates 13, 14 and 15 riveted at their ends to the undersides of the plates 11 and 12 to form a rigid frame.

The rear upper end of the frame is swung beneath the hoop by S-hooks 16 and 17 entered through holes in the plates 11 and 12, respectively, and each hook entered in an eye 9 on the hoop.

A reticular frame support member 18 is located on each side of the ball deflector member 10 and each member comprises a series of downwardly extending, inwardly inclined flexible lines 19, preferably three in number, which are each hooked at its upper end to an angularly spaced apart eye 9 on the hoop and has its lower end attached to a hole formed in a side edge portion of a plate of the frame. A series of flexible cross lines 20 interconnect the lines 19 which maintain the downwardly inclined lines 19 in position to form an upwardly opening ball receiving mouth (FIG. 1) and also restricts the interstices of the support member to dimensions smaller than the configuration of a basketball.

Figure 3:
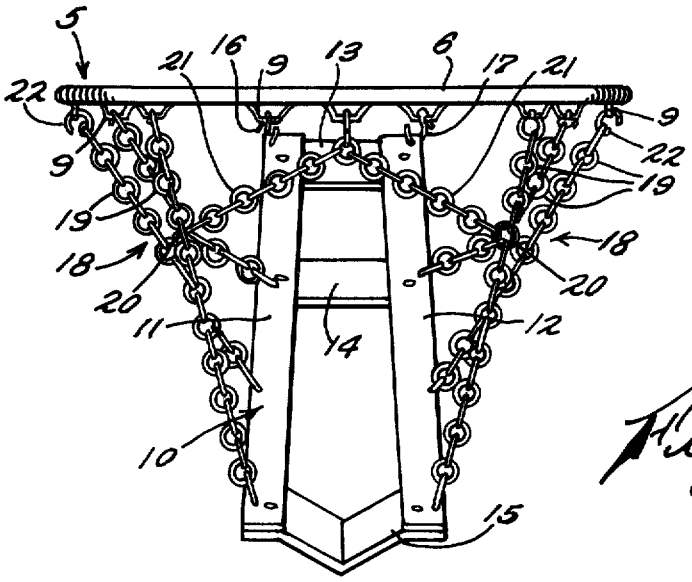
FIG. 3 is a front elevational view of my basketball practice device.

As best shown in FIG. 3 of the drawings, a pair of downwardly and outwardly extending, flexible lines 21 connect the forward lines 19—19 of the support member to a forward eye 9 of the hoop and form with said lines and the forward end of the frame member 15 a ball exit opening for the practice device.

As is depicted in the drawings all the flexible lines 19 and 20 are best constituted by twisted, wire link chains that are interconnected at their crossover points and are permanently attached at their ends to the side plates of the frame, S-hooks 22 being preferably utilized to attach the upper ends of the chains to the eyes 9 of the hoop 6. It is to be noted that the practice assembly may be hung from the basketball hoop in many angular positions by interchanging hooks and eyes, thus permitting basket shot deflections to many directions.

The twisted wire link chains 19 and 20 provide a relatively soft yet firm ball contacting reticular frame support member on each side of the ball deflector member which effectively decelerates ball motion as it passes through the assembly before the latter directs the ball back to the area in front of the basket. The frame and its attached chains assume a flat condition that is susceptible of being packaged in a corrugated box for shipment having dimensions of substantially 8 inches by 17 inches by 1½ inches, and may be taken from the box and readily hooked to the standard basketball hoop in a minimum of time.

In operation it will thus be understood that a player's practice shots that pass through the hoop 6, either straight in shots or straight backboard deflected shots, will come directly into contact with the deflector frame and be returned to the area in front of the basket, if the ball is backboard deflected, the ball will come in contact with the flexible support members 18—18 which cushion the ball first and then direct the ball to the frame and thence in the general direction in front of the basket.

What is claimed is:

1. In a basketball goal assembly including a backboard and a hoop mounted thereon, the combination therewith of a basketball practice return device comprising a downwardly extending, forwardly inclined ball deflector frame having a pair of forwardly divergent ball guide plates, cross plates connected to the pair of ball guide plates, a pair of detachable means connecting the upper narrow end of the frame closely subjacent the hoop, a series of downwardly extending, inwardly inclined wire link chains, each detachably connected at its upper end to the hoop and each chain having its lower end connected to a guide plate of the frame, cross wire link chains interconnecting the downwardly extending, inwardly inclined wire link chains, the forward chains for each guide plate forming with the wide end of the frame a ball exit opening that is disposed within the vertical boundary lines of the hoop.

* * * * *